US008053389B2

(12) United States Patent
Takehara et al.

(10) Patent No.: US 8,053,389 B2
(45) Date of Patent: Nov. 8, 2011

(54) HEAT-SENSITIVE TRANSFER IMAGE-RECEIVING SHEET

(75) Inventors: Hiroshi Takehara, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 819 days.

(21) Appl. No.: 12/095,452

(22) PCT Filed: Nov. 29, 2006

(86) PCT No.: PCT/JP2006/324302

§ 371 (c)(1), (2), (4) Date: May 29, 2008

(87) PCT Pub. No.: WO2007/064017

PCT Pub. Date: Jun. 7, 2007

(65) Prior Publication Data

US 2009/0246420 A1 Oct. 1, 2009

(30) Foreign Application Priority Data

Nov. 30, 2005 (JP) ..... 2005-346246

(51) Int. Cl.
*B41M 5/035* (2006.01)
*B41M 5/50* (2006.01)

(52) U.S. Cl. ..... 503/227; 428/32.5

(58) Field of Classification Search ..... None
See application file for complete search history.

(56) References Cited

U.S. PATENT DOCUMENTS

| | | | |
|---|---|---|---|
| 4,972,000 | A | 11/1990 | Kawashima et al. |
| 5,418,207 | A | 5/1995 | Asajima et al. |
| 5,631,076 | A | 5/1997 | Hakomori et al. |
| 6,156,420 | A | 12/2000 | Hosselbarth et al. |
| 2002/0094933 | A1 | 7/2002 | Iwasaki et al. |
| 2002/0123425 | A1 | 9/2002 | Bobsein |
| 2003/0044581 | A1 | 3/2003 | Kaeding et al. |

FOREIGN PATENT DOCUMENTS

| | | | |
|---|---|---|---|
| EP | 0 376 318 | A2 | 7/1990 |
| JP | 62-102240 | A | 5/1987 |
| JP | 4-21489 | A | 1/1992 |
| JP | 5-147364 | A | 6/1993 |
| JP | 6-155931 | A | 6/1994 |
| JP | 10-866 | A | 1/1998 |
| JP | 11-180054 | A | 7/1999 |
| JP | 11-277917 | A | 10/1999 |
| JP | 11-321128 | A | 11/1999 |
| JP | 2002-254841 | A | 9/2002 |
| JP | 2002-278456 | A | 9/2002 |
| JP | 2004-9572 | A | 1/2004 |

*Primary Examiner* — Bruce H Hess
(74) *Attorney, Agent, or Firm* — Sughrue Mion, PLLC

(57) ABSTRACT

A heat-sensitive transfer image-receiving sheet, having, on a support, at least one layer containing an organic hollow polymer, wherein the layer containing the organic hollow polymer includes at least one surfactant selected from the group consisting of an anionic surfactant and a nonionic surfactant.

6 Claims, No Drawings

HEAT-SENSITIVE TRANSFER IMAGE-RECEIVING SHEET

TECHNICAL FIELD

The present invention relates to a heat-sensitive transfer image-receiving sheet. In particular, the present invention relates to a heat-sensitive transfer image-receiving sheet that has a high sensitivity and is free from image defects.

BACKGROUND ART

Various heat transfer recording methods have been known so far. Among these methods, dye diffusion transfer recording systems attract attention as a process that can produce a color hard copy having image qualities closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

General paper may be used as a support of an image-receiving sheet in this dye diffusion transfer recording system, and it enables the image-receiving sheet to be produced at low costs. In an image-receiving sheet using such paper as the support, a layer having high cushion properties, for example, a foam layer made of a resin and a foaming agent, is formed between the support and a receptor layer, to provide cushion properties, thereby improving the adhesion between an image-receiving sheet and an ink sheet. Also, an intermediate layer is further formed between this foam layer and the receptor layer, to prevent the foam layer from being broken (flatten) by heating during printing. However, there are caused certain problems in current image-receiving sheets because of the fact that this intermediate layer is formed using an organic-solvent-type resin coating solution. The problems are that this coating solution breaks down air cells and voids in the foam layer, and thus, desired cushion properties are not attained, resulting in voids and density unevenness in the formation of an image, and further reduction in the heat insulation property of the foam layer is caused, resulting in diffusion of the calories required to transfer dyes in the direction of the backside of the image-receiving sheet, bringing about reduction in sensitivity that is required for printing.

To solve the above problems, for example, JP-A-5-147364 ("JP-A" means unexamined published Japanese patent application) discloses that a resin layer including a dye receptor layer is made to contain a hollow capsule; and also JP-A-11-321128 discloses that an intermediate layer containing, as its major components, hollow particles and a polymer resistant to an organic solvent, is formed between a support and a receptor layer. In these methods, however, the receptor layer is applied after the resin layer and the intermediate layer are applied and dried under heating. Therefore, not only do many image defects arise from formation of unevenness on the surface of the receptor layer, but also there are problems of insufficient sensitivity and rise in costs. Further, for instance, JP-A-2004-9572 discloses providing, on a paper base that exhibits a specific air permeability, with a layer containing hollow particles and a dye-receiving layer in order of mention. However, even this method cannot satisfactorily reduce the number of occurrences of image defects ascribable to bubbles released from the hollow particles at the time of image formation. Therefore, not only do many image defects arise from formation of unevenness on the surface of the receptor layer, but also there are problems of an insufficient sensitivity and rise in costs.

DISCLOSURE OF INVENTION

As a result of intensive studies, it has been found that, when at least one layer containing an organic hollow polymer is provided on a support and an anionic surfactant or/and a nonionic surfactant is incorporated into the layer, a heat-sensitive transfer image-receiving sheet can be formed without causing unevenness on the surface of a receptor layer, and thereby a highly-sensitive, image-defect-free, image-receiving sheet can be formed at a low cost. The present invention has been completed based on these findings.

According to the present invention, there is provided the following means:

(1) A heat-sensitive transfer image-receiving sheet, having, on a support, at least one layer containing an organic hollow polymer, wherein the layer containing the organic hollow polymer comprises at least one surfactant selected from the group consisting of an anionic surfactant and a nonionic surfactant.

(2) The heat-sensitive transfer image-receiving sheet as described in (1), wherein the surfactant is an anionic surfactant.

(3) The heat-sensitive transfer image-receiving sheet as described in (1) or (2), wherein the surfactant is a surfactant containing, in its partial structure, a repeating unit of an ethylene oxide.

(4) The heat-sensitive transfer image-receiving sheet as described in any of (1) to (3), wherein the surfactant is a compound represented by the following formula [I] or [II]:

Formula [I]

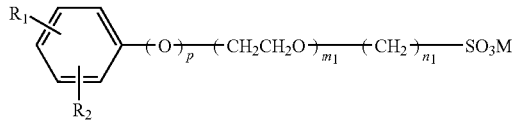

wherein, in formula [I], $R_1$ and $R_2$ each independently represent an alkyl group having 1 to 18 carbon atoms, M represents a hydrogen atom or a cation, $m_1$ represents an integer of 0 to 100, $n_1$ represents an integer of 0 to 4, and p represents 0 or 1;

Formula [II]

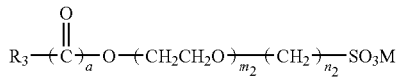

wherein, in formula [II], $R_3$ represents an alkyl group having 6 to 20 carbon atoms or an alkenyl group having 6 to 20 carbon atoms, M represents a hydrogen atom or a cation, $m_2$ represents an integer of 0 to 100, $n_2$ represents an integer of 0 to 4, and a represents 0 or 1.

The heat-sensitive transfer image-receiving sheet of the present invention has high sensitivity, is free from image defects, and can be produced at low costs.

Other and further features and advantages of the invention will appear more fully from the following description.

BEST MODE FOR CARRYING OUT INVENTION

The present invention will be explained in detail below.

The heat-sensitive transfer image-receiving sheet of the present invention is provided with a dye-receiving layer (receptor layer) formed on a support. It is preferable to form an undercoat layer between the receptor layer and the support. As the undercoat layer, for example, a white-background-control layer, a charge-control layer, an adhesive layer, and a primer layer can be formed. Also, a heat insulation layer is preferably formed between the undercoat layer and the support. In the present invention, each layer interposed between the support and the receptor layer will be simply called "intermediate layer", which includes the foregoing undercoat layer and heat insulation layer. It is preferable that a curling-control layer, a writing layer (a writable layer), and a charge-control layer be formed on the backside of the support.

In addition, the heat-sensitive transfer image-receiving sheet of the present invention has at least one layer containing an organic hollow polymer. The layer containing an organic hollow polymer is preferably a receptor layer or an intermediate layer, more preferably an intermediate layer, and particularly preferably an intermediate layer functioning as a heat insulation layer.

(Receptor Layer)

The receptor layer serves to receive dyes transferred from an ink sheet and to maintain an image formed by these dyes. Therefore, a resin that is easily dyed (hereinafter referred to as a dyeable receiving polymer or a receptor polymer capable of being dyed) is used in the receptor layer. As the resin for the receptor layer, the following compounds may be used either singly or as a mixture, though the present invention is not limited to the following compounds: polyolefin resins such as polyethylenes and polypropylenes; halogenated resins such as polyvinyl chlorides and polyvinylidene chlorides; vinyl-series resins such as polyvinyl acetates and polyacrylates, and their copolymers; polyester-series resins such as polyethylene terephthalates and polybutylene terephthalates; polystyrene-series resins; polyamide-series resins; polycarbonates; phenol resins; polyurethanes; epoxy resins; polysulfones; butyral resins; melamine resins; polyvinyl alcohols; copolymers of olefins, such as ethylenes and propylenes, and other vinyl type monomers; vinyl chloride/vinyl acetate copolymers; styrene/acryl copolymers; ionomers; cellulose resins; natural rubbers; and synthetic rubbers. In the present invention, polymers having a vinyl chloride repeating unit as a main chain are particularly preferable. The receptor polymer for use in the receptor layer may be a latex polymer.

The degree of capability of being dyed is defined as follows. Four colors, specifically, yellow, magenta, cyan, and black, are outputted so as to form a solid image having a 256 gradation on image-receiving sheets, and the reflection density of each of the resulting image is measured, to define a polymer that provided an image having the highest reflection density as a receptor polymer having good capability of being dyed. It is necessary to pay special attention to the capability of being dyed of a receptor polymer because it can vary depending on the type of printer and the type of ink sheet.

<Latex Polymer>

The latex polymer that can be used in the present invention will be explained. The heat-sensitive transfer image-receiving sheet of the present invention may contain a latex polymer in the receptor layer. The term "latex polymer" used herein means a dispersion comprising a hydrophobic, water-insoluble polymer, dispersed in a water-soluble dispersion medium, as fine particles. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm. The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

In the present invention, as preferable types of latex polymer, hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to a layer containing a latex, and polymers having excessively large molecular weight bring about poor filming ability, and therefore both cases are undesirable. Crosslinkable latex polymers are also preferably used.

No particular limitation is imposed on the monomer to be used in synthesizing the latex polymer that can be used in the present invention, and the following monomer groups (a) to (j) may be preferably used as those polymerizable in a usual radical polymerization or ion polymerization method. These monomers may be selected singly or combined freely to synthesize a latex polymer.

—Monomer Groups (a) to (j)—

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates such as methyl acrylate, ethyl acrylate, butyl acrylate, cyclohexyl acrylate, 2-ethylhexyl acrylate, and dodecyl acrylate; substituted alkyl acrylates such as 2-chloroethyl acrylate, benzyl acrylate, and 2-cyanoethyl acrylate; alkyl methacrylates such as methyl methacrylate, butyl methacrylate, 2-ethylhexyl methacrylate, and dodecyl methacrylate; substituted alkyl methacrylates such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids such as monobutyl maleate, dimethyl maleate, monomethyl itaconate, and dibutyl itaconate; multifunctional esters such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl) acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Latex polymers that can be used in the present invention are also commercially available, and polymers described below may be utilized.

Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857x2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nisshin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS, and 1610NS (trade names, manufactured by Dainippon Ink and Chemicals, Incorporated); D-1000, D-2000, D-6000, D-4000, and D-9000 (trade names, manufactured by Dainichi seika Color & Chemicals Mfg. Co., Ltd.); NS-155X, NS-310A, NS-30X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyvinyl chlorides include G351, and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, and 950 (trade names, manufactured by Nisshin Chemical Industry Co., Ltd.).

Examples of polyvinylidene chlorides include L502 and L513 (trade names, manufactured by Asahi Kasei Corporation); D-5071 (trade name, manufactured by Dai-Nippon Ink & Chemicals, Inc.).

Examples of polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68JIN, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended.

In the present invention, it is preferable to prepare the receptor layer by applying an aqueous type coating solution and then drying it. The "aqueous type" so-called here means that 60% by mass or more of the solvent (dispersion medium) of the coating solution is water. As components other than water in the coating solution, water miscible organic solvents may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of the latex polymer. It is described in Souichi Muroi, "Gosei Latex no Kagaku (Chemistry of Synthetic Latex)", issued by Kobunshi Kanko Kai (1970). Preferable examples of the filming aid are listed below, but the compounds for use in the invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

Preferable examples of the latex polymer that can be used in the present invention may include polylactates, polyurethanes, polycarbonates, polyesters, polyacetals, SBRs, and polyvinyl chlorides. It is most preferable that, among these compounds, polyesters, polycarbonates, and polyvinyl chlorides be included.

In combination with the latex polymer for use in the present invention, any polymer can be used. The polymer that can be used in combination is preferably transparent or translucent, and generally colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, the binder may be dissolved or dispersed in an aqueous solvent or in an organic solvent, or may be in the form of an emulsion.

The glass transition temperature (Tg) of the binder for use in the invention is preferably in the range of −30° C. to 70° C., more preferably −10° C. to 50° C., still more preferably 0° C. to 40° C., in view of film-forming properties (brittleness for working) and image storability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

The polymer used for the binder for use in the invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare a water dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomer are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image storability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier may be selected from anionic surfactants, nonionic surfactants, cationic surfactants, and ampholytic surfactants. Among them, anionic surfactants are preferable from the viewpoints of dispersibility and image storability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS—H manufactured by Kao Corporation, trade name) are still more preferable, and low electrolyte types such as PIONIN A-43-S (manufactured by Takemoto Oil & Fat Co., Ltd., trade name) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetate, ethylenediaminetetraacetate), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative for use in the present invention include the compounds shown in the Table attached to "EDTA (-Complexane no Kagaku-) (EDTA-Chemistry of Complexane-)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl) iminodiacetic acid, N-(carbamoylmethyl)imino diacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraactic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis (ethyliminodiacetic acid), 2,2'-ethylenedioxy-bis (ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N""-hexaacetic acid, and 1,2,3-triaminopropane-N,N,N',N",N'",N""-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the latex polymer to be used in the present invention, the polymer concentration is, based on the amount of the latex liquid, preferably 10 mass % to 70 mass %, more preferably 20 mass % to 60 mass %, and especially preferably 30 mass % to 55 mass %.

The latex polymer in the image-receiving sheet of the present invention includes a state of a gel or dried film formed by removing a part of solvents by vaporization.

<Ultraviolet Absorber>

Also, in the present invention, in order to improve light resistance, an ultraviolet absorber may be added to the receptor layer. In this case, if this ultraviolet absorber is made to have a higher molecular weight, it can be secured to a receptor layer so that it can be prevented, for instance, from being diffused into an ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described, for example in JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added in the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a weight average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, a water dispersion-system coating solution may be used in application and coating to form the receptor layer, and this enables reduction of production cost. As a method of making the latex polymer (or making the polymer latex-wise), a method described, for example, in Japanese Patent No. 3,450,339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The amount of the ultraviolet-absorber-grafted polymer or its latex is preferably 5 to 50 parts by mass, and more preferably 10 to 30 parts by mass, to 100 parts by mass of the receptor polymer capable of being dyed or its latex to be used to form the receptor layer.

<Releasing Agent>

Also, a releasing agent may be compounded in the receptor layer, in order to prevent thermal fusion with a thermal transfer sheet (ink sheet) when an image is formed. As the releasing agent, a silicone oil, a phosphate-based plasticizer, or a fluorine-series compound may be used, and silicone oil is particularly preferably used. As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil is preferably used. Among these compounds, a reaction product between a vinyl-modified silicone oil and a hydrogen-modified silicone oil is preferable. The amount of the releasing agent is preferably 0.2 to 30 parts by mass, to 100 parts by mass of the receptor polymer.

The amount of the receptor layer to be applied is preferably 0.5 to 10 g/m$^2$ (solid basis, hereinafter, the amount to be applied in the present invention is a value on solid basis unless otherwise noted).

The film thickness of the receptor layer is preferably 1 to 20 μm.

(Intermediate Layer <Undercoat Layer>)

An undercoat layer is preferably formed between the receptor layer and the support. As the undercoat layer, for example, a white background regulation layer, a charge regulation layer, an adhesive layer, or a primer layer is formed.

These layers may be formed in the same manner as those described in, for example, each specification of Japanese Patent Nos. 3,585,599 and 2,925,244.

(Intermediate Layer <Heat Insulation Layer>)

A heat insulation layer (a foam layer) serves to protect the support from heat when a thermal head is used to carry out a transfer operation under heating. Also, because the heat insulation layer has high cushion characteristics, a thermal transfer image-receiving sheet having high printing sensitivity can be obtained even in the case of using paper as a substrate.

The heat-sensitive transfer image-receiving sheet of the present invention has, on a support, at least one layer containing an organic hollow polymer, and it is preferable that the layer containing an organic hollow polymer be a heat insulation layer.

The hollow polymer in the present invention is polymer particles having independent pores inside of the particles. Examples of the hollow polymer include 1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; 2) foaming type microballoons obtained in the following manner: a low-boiling point liquid such as butane and pentane is encapsulated in a resin constituted of any one, a mixture or a polymer of polyvinylidene chloride, polyacrylonitrile, polyacrylic acid, and polyacrylate, and after the resin coating material is applied, it is heated to expand the low-boiling point liquid inside of the particles whereby the inside of each particle is made to be hollow; and 3) microballoons obtained by foaming the above 2) under heating in advance, to make a hollow polymer.

These hollow polymers preferably have a hollow ratio of about 20 to 70%, and may be used in combinations of two or more. Specific examples of the above 1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above 2) include F-30 and F-50 manufactured by Matsumoto Yushi-Seiyaku Co., Ltd. (all of these product names are trade names). Specific examples of the above 3) include F-30E manufactured by Matsumoto Yushi-Seiyaku Co., Ltd, and Expancel 461DE, 551DE and 551DE20 manufactured by Nippon Ferrite (all of these product names are trade names).

A water-dispersible resin or water-soluble type resin is preferably contained, as a binder, in the intermediate layer containing the hollow polymer. As the binder resin for use in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride, cellulose derivative, casein, starch, and gelatin may be used. Also, these resins may be used either singly or as mixtures.

The solid content of the hollow polymer in the intermediate layer preferably falls in a range from 5 to 2,000 parts by mass when the solid content of the binder resin is 100 parts by mass. Also, the ratio by mass of the solid content of the hollow polymer in the coating solution is preferably 1 to 70% by mass and more preferably 10 to 40% by mass. If the ratio of the hollow polymer is excessively low, sufficient heat insulation cannot be obtained, whereas if the ratio of the hollow polymer is excessively large, the adhesion between the hollow polymers is reduced, posing problems, for example, powder fall or film separation.

The particle size of the hollow polymer is preferably 0.1 to 20 μm, more preferably 0.1 to 2 μm and particularly preferably 0.1 to 1 μm. Also, the glass transition temperature (Tg) of the hollow polymer is preferably 70° C. or more and more preferably 100° C. or more.

The heat insulation layer may be made of a resin and a foaming agent. As the resin for the heat insulation layer, any of known resins, such as urethane resins, acryl resins, methacryl resins, and modified olefin resins, or those obtained by blending these resins may be used. Each of these resins is dissolved and/or dispersed in an organic solvent or water and the resulting solution is applied to form a heat insulation layer. The heat-insulation-layer coating solution is preferably an aqueous-type coating solution having no influence on the foaming agent. As the coating solution, for example, a water-soluble, water-dispersible, or SBR latex, emulsions including a urethane-series emulsion, polyester emulsion, emulsion of vinyl acetate and its copolymer, emulsion of a copolymer of acryl types such as acryl or acrylstyrene, vinyl chloride emulsion, or dispersions of these emulsions may be used. When a microsphere, which will be explained later, is used as the foaming agent, it is preferable to use an emulsion of vinyl acetate or its copolymer or an emulsion of a copolymer of acryl such as acryl or acrylstyrene.

Because the glass transition point, softness, and film-forming characteristics of these resins can be easily controlled by changing the kind and ratio of the monomer to be copolymerized, these resins are suitable in the points that desired characteristics can be obtained even if a plasticizer and filming adjuvant are not added, that a resultant film is reduced in a change in color during storage in various environments, and that these are reduced in a change of material properties after lapse of time. Also, among the above resins, a SBR latex is undesirable because it usually has a low glass transition point, tends to cause blocking and tends to be yellowed after a film is formed or while it is stored. A urethane-series emulsion is undesirable because many urethane emulsions contain solvents such as NMP and DMF and therefore tends to have an adverse influence on a foaming agent. A polyester emulsion or dispersion and a vinyl chloride emulsion are undesirable because they generally have high glass transition points, and cause a deterioration in foaming characteristics of a microsphere. Though there are those which are soft, they are not used preferably because the softness is imparted by adding a plasticizer.

The foaming characteristics of the foaming agent are largely affected by the hardness of a resin. In order for the foaming agent to foam the resin at a desired expansion ratio, the resin is preferably one having a glass transition point of −30 to 20° C. or a minimum film-forming temperature (MFT) of 20° C. or less. Resins having a too-high glass transition point lack in softness and cause deterioration in the foaming characteristics of the foaming agent. Also, resins having a too-low glass transition point give rise to blocking caused by adhesiveness (generated on the foaming layer and on the backside of the substrate when the substrate on which the foaming layer has been formed is rolled) and cause defects when the heat transfer image-receiving sheet is cut (for instance, when the image-receiving sheet is cut, the resin of the foaming layer adheres to a cutter blade, which deteriorates outward appearance or allows cutting dimension to be out of order). Also, resins having a too-high minimum film-forming temperature cause film-forming inferiors during coating and drying, giving rise to disorders such as surface cracks.

Examples of the foaming agent include known foaming agents, for example, decomposition type foaming agents, such as dinitropentamethylenetetramine, diazoaminobenzene, azobisisobutyronitrile, and azodicarboamide, which are decomposed by heating to generate gases, such as oxygen, hydrocarbon gas, or nitrogen; and microspheres obtained by encapsulating a low-boiling point liquid such as butane and pentane with a resin such as polyvinylidene chloride or polyacrylonitrile, to form a microcapsule. Among these materials, microspheres obtained by encapsulating a low-boiling point liquid such as butane and pentane with a resin such as polyvinylidene chloride or polyacrylonitrile, to form a microcapsule are preferably used. These foaming agents are respectively foamed by heating after the foam layer is formed, and the resulting foamed layer has high cushion characteristics and heat insulation characteristics. The amount of the foaming agent is preferably in a range preferably from 0.5 to 100 parts by mass based on 100 parts by mass of the resin used to form the foaming layer. When the amount is too small, the cushion characteristics of the foam layer are reduced and therefore, the effect of the foam layer is not obtained. When the amount is too large, the hollow ratio of the foamed layer becomes so large that the mechanical strength of the foam layer is reduced and the foam layer cannot stand to usual handling. Also, the surface of the foam layer loses smoothness, producing an adverse effect on the outward appearance and image quality. Also, the thickness of the whole foam layer is preferably 30 to 100 μm. When the thickness is too thin, the foam layer has insufficient cushion characteristics and insulation properties, whereas when the thickness is too thick, the effect of the foam layer is not improved, bringing about reduced strength. Also, as to the particle diameter of the foaming agent, the volume average particle diameter of the foaming agent before the foam layer is foamed is about 5 to 15 μm and the volume average particle diameter of the foaming agent after the foam layer is foamed is 20 to 50 μm. Foaming agents having a too-small volume average particle diameter before the foam layer is foamed or foaming agents having a too-small volume average particle diameter after foamed have a low cushion effect. Foaming agents having a too-large volume average particle diameter before the foam layer is foamed or foaming agents having a too-large volume average particle diameter after foamed each make the surface of the foam layer irregular, and eventually have an adverse influence on the quality of the formed image. Therefore, an amount out of the above range is undesirable.

It is particularly preferable to use, among the above foaming agents, a low-temperature foaming type micropsphere in which the softening point of the capsule wall and foaming start temperature are respectively 100° C. or less, and which has an optimum foaming temperature (the temperature at which the expansion ratio is highest when a heating time is set to one minute) of 140° C. or less, so as to make the heating temperature as low as possible when the foaming agent is foamed. The use of a microsphere having a lower foaming temperature makes it possible to prevent thermal wrinkles and curling of the substrate at the time of foaming. This microsphere having a low foaming temperature can be obtained by controlling the amount of a thermoplastic resin such as polyvinylidene chloride and polyacrilonitrile which forms the capsule wall. The volume average particle diameter is preferably 5 to 15 μm. The foam layer formed using this microsphere has the advantages that air cells obtained by forming are closed cells, the foam layer is foamed using a simple process using only heating, and the thickness of the foam layer can be easily controlled by the amount of the microsphere to be compounded.

However, this microsphere is not resistant to an organic solvent. When a coating solution using an organic solvent is used for the foam layer, the capsule wall of the microsphere is eroded, resulting in deteriorated foaming characteristics. Therefore, when a microsphere like the above is used, it is desirable to use an aqueous type coating solution that does not contain organic solvents, for example, ketones such as acetone and methyl ethyl ketone, esters such as ethyl acetate, and lower alcohols such as methanol and ethanol, which erode the capsule wall. Accordingly, it is desirable to use an aqueous type coating solution, specifically, a solution using a water-soluble or water-dispersible resin or a resin emulsion, and preferably an acrylstyrene emulsion or a modified vinyl acetate emulsion. Also, even if an aqueous type coating solution is used to form a foam layer, a coating solution formulated with a high-boiling point and highly polar solvent such as NMP, DMF, or cellosolve, as a cosolvent, a film-forming auxiliary, or a plasticizer has an adverse influence on the microsphere. It is therefore necessary to take it into account, for example, to seize the composition of the aqueous resin to be used and the amount of the high-boiling point solvent to be added, to thereby confirm whether the microcapsule could be adversely affected or not.

In addition, the heat-sensitive transfer image-receiving sheet of the present invention contains a surfactant in the layer containing the organic hollow polymer. The surfactant is added in an amount of preferably 0.1 to 50 mass %, more preferably 0.1 to 10 mass %, particularly preferably 0.2 to 2 mass %, based on the organic hollow polymer.

The surfactant for use in the present invention is any of anionic or nonionic surfactants, and these surfactants may be used singly or in combination. The surfactant for use in the present invention is preferably a surfactant having a repeating unit of ethylene oxide in its partial structure. Additionally, it is preferable in the present invention that at least one kind of anionic surfactant be incorporated.

As examples of the anionic surfactant that can be preferably used in the present invention, compounds represented by the following formulae [I] to [VI] can be mentioned.

Formula [I]

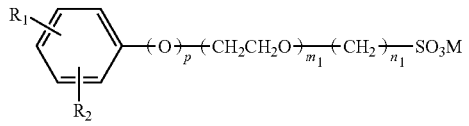

In the formula, $R_1$ and $R_2$ each independently represent an alkyl group having 1 to 18 carbon atoms, M represents a hydrogen atom or a cation, $m_1$ represents an integer of 0 to 100, $n_1$ represents an integer of 0 to 4, and p represents 0 or 1.

Formula [II]

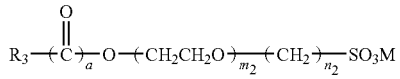

In the formula, $R_3$ represents an alkyl group having 6 to 20 carbon atoms or an alkenyl group having 6 to 20 carbon atoms, M represents a hydrogen atom or a cation, $m_2$ represents an integer of 0 to 100, $n_2$ represents an integer of 0 to 4, and a represents 0 or 1.

Formula [III]

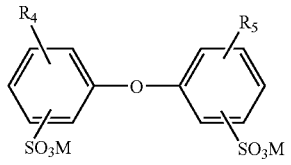

In the above formula, $R_4$ represents an alkyl group having 6 to 18 carbon atoms, $R_5$ represents a hydrogen atom or an alkyl group having 6 to 18 carbon atoms, and M represents a hydrogen atom or a cation. Preferably, $R_4$ and $R_5$ each independently represent an alkyl group having 6 to 18 carbon atoms.

Formula [IV]

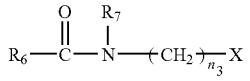

In the above formula, $R_6$ represents an alkyl group having 6 to 20 carbon atoms, $R_7$ represents an alkyl group having 1 to 4 carbon atoms, X represents —COOM or —$SO_3M$, M represents a hydrogen atom or a cation, and $n_3$ represents an integer of 1 to 4.

Formula [V]

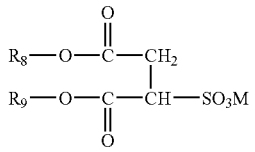

In the above formula, $R_8$ and $R_9$ each independently represent an alkyl group having 5 to 20 carbon atoms, and M represents a hydrogen atom or a cation.

Formula [VI]

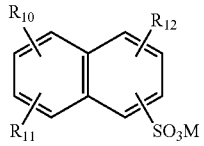

In the above formula, $R_{10}$ and $R_{12}$ each independently represent an alkyl group having 1 to 16 carbon atoms, $R_{11}$ represents a hydrogen atom or an alkyl group having 1 to 16 carbon atoms, and M represents a hydrogen atom or a cation.

The surfactants represented by formulae [I] to [VI] will be explained below in more detail.

Examples of the alkyl group having 1 to 18 carbon atoms designated by $R_1$ or $R_2$ include methyl, ethyl, butyl, octyl, decyl, dodecyl, and octadecyl.

Examples of the alkyl group having 6 to 20 carbon atoms designated by $R_3$, $R_6$, $R_8$, or $R_9$ include hexyl, heptyl, octyl, dodecyl, octadecyl, and eicosyl.

Examples of the alkyl group having 5 to 18 carbon atoms designated by $R_4$ or $R_5$ include hexyl, heptyl, dodecyl, pentadecyl, and octadecyl. The number of carbon atoms in the alkyl group designated by $R_4$ or $R_5$ is preferably 6 to 18.

Examples of the alkyl group having 1 to 4 carbon atoms designated by $R_7$ include methyl, ethyl, propyl, and butyl.

Examples of the alkyl groups having 1 to 16 carbon atoms designated by $R_{10}$, $R_{11}$, or $R_{12}$ include methyl, ethyl, butyl, decyl, dodecyl, and hexadecyl.

The alkyl groups designated by $R_1$ to $R_{12}$ may each optionally have a substituent. In such cases, the number of carbon atoms in each substituent is not included in the number of carbon atoms as specified above with respect to each alkyl group.

Examples of the alkenyl group having 6 to 20 carbon atoms designated by $R_3$ include 2-butenyl, and 8-heptadecenyl.

Of the surfactants represented by the foregoing formulae [I] to [VI], the present invention prefers the compounds represented by formulae [I] or [II] over the others.

As to the compounds represented by formulae [I] or [II], the cases where $m_1$ and $m_2$ are each an integer of 0 to 60 are preferable.

Specific examples of those compounds are illustrated below, but compounds usable in the present invention are not limited to these examples.

a-1

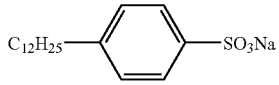

a-2

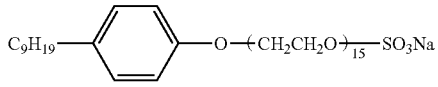

a-3

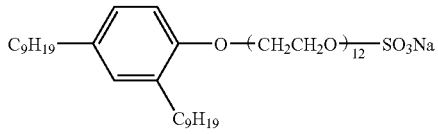

a-4

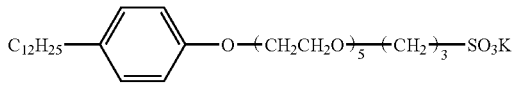

a-5 a-6 a-7 a-8

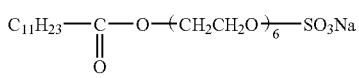

a-9

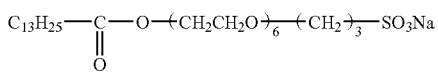

a-10

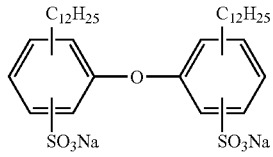

a-11

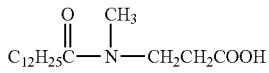

-continued a-12

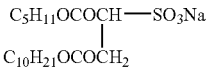

a-13

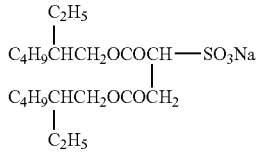

a-14

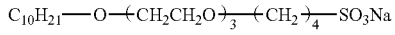

a-15

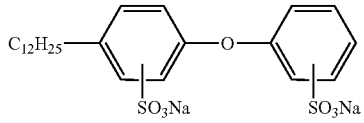

a-16

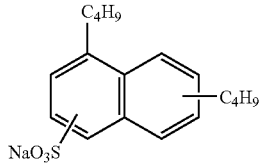

Next, nonionic surfactants that can be preferably used in the present invention will be explained.

Examples of such nonionic surfactants include compounds represented by the following formulae [N-I], [N-II], or [N-III].

Formula [N-I]

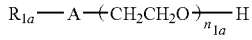

Formula [N-II]

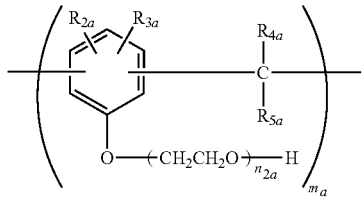

Formula [N-III]

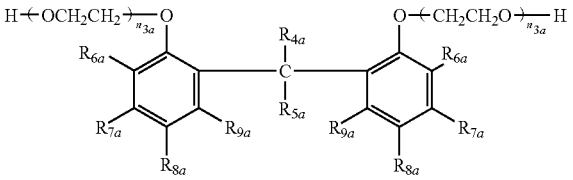

In the above formulae, $R_{1a}$ represents a hydrogen atom, an alkyl group having 1 to 30 carbon atoms, an alkenyl group having 1 to 30 carbon atoms, or an aryl group having 6 to 30 carbon atoms, and these groups each may include those having a substituent. $R_{1a}$ is preferably an alkyl group having 4 to 24 carbon atoms, an alkenyl group having 4 to 24 carbon atoms, or an aryl group having 6 to 24 carbon atoms; and particularly preferred examples include hexyl, dodecyl, isostearyl, oleyl, t-butylphenyl, 2,4-di-t-butylphenyl, 2,4-di-t-pentylphenyl, p-dodecylphenyl, m-pentadecanylphenyl, t-octylphenyl, 2,4-dinonylphenyl, or octylnaphthyl.

A represents —O—, —S—, —COO—, —OCO—, >N—$R_{10a}$, —CO—($R_{10a}$)N—, or —$SO_2$—($R_{10a}$)N— (wherein $R_{10a}$ represents a hydrogen atom or an alkyl group which may have a substituent).

$R_{2a}$, $R_{3a}$, $R_{7a}$, and $R_{9a}$ each independently represent a hydrogen atom, an alkyl group, an aryl group, an alkoxy group, an aryloxy group, a halogen atom, an acyl group, an amido group, a sulfonamido group, a carbamoyl group, or a sulfamoyl group, and these groups each may have a substituent.

$R_{6a}$ and $R_{8a}$ each independently represent an alkyl group, an aryl group, an alkoxy group, an aryloxy group, a halogen atom, an acyl group, an amido group, a sulfonamido group, a carbamoyl group, or a sulfamoyl group, and these groups each may have a substituent.

$R_{6a}$ and $R_{8a}$ each are preferably an alkyl group having 1 to 20 carbon atoms; an aryl group having 6 to 20 carbon atoms, such as a phenyl group and a p-chlorophenyl group; an alkoxy or aryloxy group represented by —$OR_{15a}$ (wherein $R_{15a}$ represents an alkyl group having 1 to 20 carbon atoms or an aryl group having 6 to 20 carbon atoms, and these groups may each have a substituent); a halogen atom, such as a chlorine atom and a bromine atom; an acyl group represented by —$COR_{15a}$; an amido group represented by —$NR_{16a}COR_{15a}$ (wherein $R_{16a}$ represents a hydrogen atom or an alkyl group having 1 to 20 carbon atoms); a sulfonamido group represented by —$NR_{16a}SO_2R_{15a}$, a carbamoyl group represented by —$CONR_{16a}R_{16a}$, or a sulfamoyl group represented by —$SO_2NR_{16a}R_{16a}$. Of these groups, $R_{6a}$ and $R_{8a}$ each are more preferably an alkyl group or a halogen atom, most preferably a tertiary alkyl group, such as t-butyl, t-amyl, or t-octyl.

$R_{2a}$, $R_{3a}$, $R_{7a}$, and $R_{9a}$ each are preferably a hydrogen atom or any of the groups recited above as the preferable examples of $R_{6a}$ and $R_{8a}$. Of these, $R_{7a}$ and $R_{9a}$ each are particularly preferably a hydrogen atom.

$R_{4a}$ and $R_{5a}$ each independently represent a hydrogen atom, an alkyl group, or an aryl group. These groups each may have a substituent. $R_{4a}$ and $R_{5a}$ each are particularly preferably a hydrogen atom, an alkyl group having 1 to 8 carbon atoms, a phenyl group, a furyl group, or the like.

$R_{4a}$ and $R_{5a}$; $R_{6a}$ and $R_{7a}$; and $R_{1a}$ and $R_{9a}$ each may bond to each other to form a ring, such as a cyclohexyl ring. Additionally, the substituents on the benzene rings in formula [N-III] may be bilaterally asymmetrical.

$n_{1a}$, $n_{2a}$, $n_{3a}$, and $n_{4a}$ each independently represent an average number of moles of added ethylene oxide, and each are a number ranging from 2 to 100, preferably from 2 to 80, far preferably from 3 to 70, particularly preferably from 5 to 60. $n_{3a}$ and $n_{4a}$ may be the same or different. $m_a$ is an integer of 2 to 50.

These compounds are disclosed, e.g., in U.S. Pat. Nos. 2,982,651, 3,428,456, 3,457,076, 3,454,625, 3,552,972, and 3,655,387, JP-B-51-9610, JP-A-53-29715, JP-A-54-89626, Japanese Patent Application Nos. 57-85764 and 57-90909; and "Shin-Kaimen Kasseizai (New Surfactants)", by Hiroshi Horiguchi, Sankyo Publishing Co., Ltd. (1975).

Specific examples of nonionic surfactants that can be preferably used in the present invention are illustrated below.

N-1

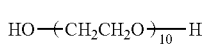

N-2

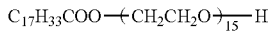

N-3

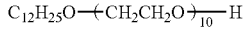

-continued

N-4

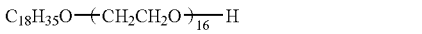

N-5

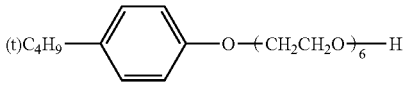

N-6

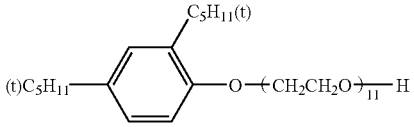

N-7

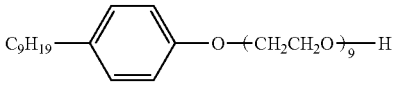

N-8

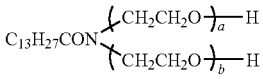

a + b = 15

N-9

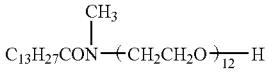

N-10

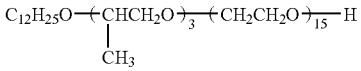

N-11

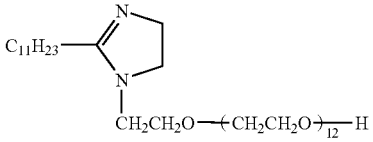

N-12

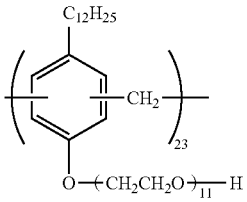

N-13

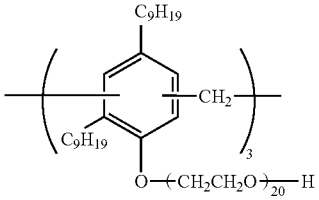

N-14

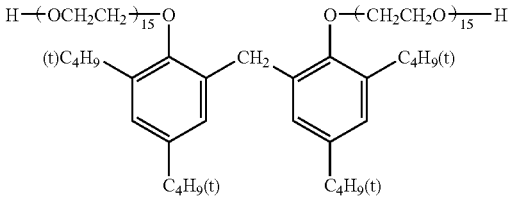

-continued

N-15

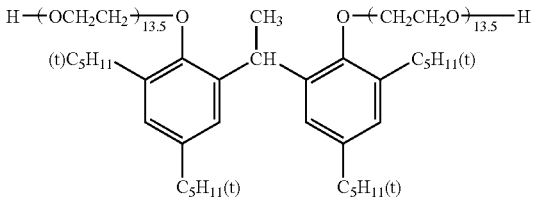

N-16

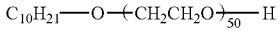

The intermediate layer (including an undercoat layer and a heat insulation layer) preferably contains a gelatin. The amount of the gelatin in the coating solution for the intermediate layer is preferably 0.5 to 14% by mass, and particularly preferably 1 to 6% by mass. Also, the coating amount of the above hollow polymer in the intermediate layer is preferably 1 to 100 g/m$^2$, and more preferably 5 to 20 g/m$^2$.

The thickness of the intermediate layer containing the hollow polymer is preferably 5 to 50 μm, and more preferably 5 to 40 μm.

(Support)

As the support, coated paper, WP paper (double side laminated paper) or the like may be used.

—Coated Paper—

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

—Laminated Paper—

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, a low-density polyethylene is used as the polyolefin. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the substrate is exposed as it is, there is the case where the heat-sensitive transfer image-receiving sheet is made to curl by moisture and temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, each publication of JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

A method of producing the heat-sensitive transfer image-receiving sheet of the present invention will be hereinafter explained.

The heat-sensitive transfer image-receiving sheet of the present invention may be formed by simultaneously applying at least one intermediate layer and a receptor layer as a multilayer, to the surface of a support. It is known that in the case of producing an image-receiving sheet of a multilayered structure, which sheet has layers having different functions from each other (for example, an air cell layer, heat insulation layer, intermediate layer, and receptor layer) on a support, it may be produced by applying and overlapping each layer one by one, or by pasting layers prepared in advance by coating a support with each layer, as shown in, for example, each publication of JP-A-2004-106283, JP-A-2004-181888, and JP-A-2004-345267.

It has been known in photographic industries, on the other hand, that productivity can be greatly improved by applying plural layers simultaneously as a multilayer. There are known methods such as the so-called slide coating (slide coating method) and curtain coating (curtain coating method) as described in, for example, each publication or specification of U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, it has been found that the productivity is greatly improved and image defects can be remarkably reduced at the same time, by using the above simultaneous multilayer coating for the production of an image-receiving sheet having a multilayer structure.

The plural layers in the present invention are structured using resins as its major components. Coating solutions forming each layer are preferably water-dispersible latexes. The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water dispersed latex may contain known additives, such as surfactants, dispersants, and binder resins, according to the need.

In the present invention, it is preferred that a laminate composed of plural layers be formed on a support and rapidly dried, according to the method described in U.S. Pat. No. 2,761,791. For example, in the case of a multilayer structure that solidifies using a resin, it is preferable to raise the temperature immediately after the plural layers are formed on the support. Also, in the case where a binder (e.g., a gelatin) that is gelled at lower temperatures is contained, there is the case where it is preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of the layers in the multilayer structure may be arbitrarily selected from a number of 2 or more. The receptor layer is preferably disposed as a layer most apart from the support.

A heat-sensitive transfer sheet (ink sheet) to be used together with the aforementioned heat-sensitive transfer image-receiving sheet according to the present invention in the formation of a thermal-transferred image, can be produced by disposing a dye layer containing a diffusion transfer dye on a support. As the heat-sensitive transfer sheet, any ink sheet may be used. As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention will be explained in more detail by way of examples, which are, however, not intended to be limiting of the present invention.

EXAMPLES

Reference Example

Production of an Ink Sheet

A polyester film 6.0 μm in thickness (trade name: Lumirror, manufactured by Toray Industries, Inc.) was used as the substrate film. A heat-resistant slip layer (thickness: 1 μm) was formed on the backside of the film, and the following yellow, magenta, and cyan compositions were respectively applied as a monochromatic layer (coating amount: 1 g/m$^2$ when the layer was dried) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

| Magenta composition | |
|---|---|
| Magenta dye (Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

| Cyan composition | |
|---|---|
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

Example 1

Production of Image-Receiving Sheets (1-1) Production of Sample 101

Comparative Example

A paper support, on both sides of which polyethylene was laminated, was subjected to corona discharge treatment on the surface thereof, and then a gelatin undercoat layer containing sodium dodecylbenzenesulfonate was disposed on the treated surface. Then, an intermediate layer A having the following composition was applied by a bar coater and dried, and in succession, a receptor layer A having the following composition was applied by a bar coater and dried. The application using a bar coater was carried out at 40° C., and the drying of each layer was carried out at 50° C. for 16 hours. These layers were applied such that the coating amount of each layer after being dried would be as follows: the intermediate layer A: 1.0 g/m$^2$ and the receptor layer A: 8.0 g/m$^2$.

| Intermediate layer A | |
|---|---|
| Polyester resin (trade name: Vylon 200, manufactured by Toyobo Co., Ltd.) | 10 parts by mass |
| Fluorescent whitening agent (trade name: Uvitex OB, manufactured by Ciba Specialty Chemicals) | 1 part by mass |
| Titanium oxide | 30 parts by mass |
| Methyl ethyl ketone/toluene (1/1, at mass ratio) | 90 parts by mass |

| Receptor layer A | |
|---|---|
| Vinyl chloride-series latex (trade name: Vinyblan 609, Nisshin Chemical Industry Co., Ltd.) | 48 parts by mass |
| Benzotriazole type ultraviolet absorber latex polymer (trade name: ULS 1700, manufactured by Ipposha Oil Industries Co., Ltd.) | 15 parts by mass |
| Wax montanate (trade name: J537, manufactured by Chukyo Yushi Co., Ltd.) | 10 parts by mass |

(1-2) Production of Sample 102

Comparative Example

A paper support, on both sides of which polyethylene was laminated, was subjected to corona discharge treatment on the surface thereof, and then a gelatin undercoat layer containing sodium dodecylbenzenesulfonate was disposed on the treated surface. On this undercoat layer, an intermediate layer B having the following composition, and the same intermediate layer A and receptor layer A as respectively used in Sample 101 were coated in a multilayered state, in which those layers were laminated in order of mention from the support, by use of known slide coating and curtain coating methods. Immediately after the coating, these layers were dried at 50° C. for 16 hours. Therein, the coating was carried out such that the coating amount of each layer after being dried would be as follows: the intermediate layer B: 15 g/m$^2$, the intermediate layer A: 1.0 g/m$^2$, and the receptor layer: 4.0 g/m$^2$, respectively.

| Intermediate layer B | |
|---|---|
| Hollow latex polymer (Trade name: MH5055, manufactured by Nippon Zeon Co., Ltd.) | 563 parts by mass |
| Gelatin | 120 parts by mass |

Here, the hollow latex polymer was a water-dispersion of a polymer having an outside diameter of 0.5 μm and a hollow structure.

(1-3) Production of Sample 103 (This Invention)

Sample 103 was produced in the same manner as Sample 102, except that the intermediate layer B was replaced with an intermediate layer C (formed by adding a surfactant to the intermediate layer B, as shown below).

| Intermediate layer C | |
|---|---|
| Hollow latex polymer (Trade name: MH5055, manufactured by Nippon Zeon Co., Ltd.) | 563 parts by mass |
| Gelatin | 120 parts by mass |
| Surfactant a-1 | 5 parts by mass |

(1-4) Production of Samples 104 to 108 (This Invention)

Samples 104 to 108 were produced in the same manner as Sample 103, except that the surfactant in the intermediate layer C was replaced with surfactants shown in Table 1, respectively.

TABLE 1

| Sample No. | Surfactant | Amount |
|---|---|---|
| 103 | a-1 | 5 parts by mass |
| 104 | a-7 | 5 parts by mass |
| 105 | a-8 | 5 parts by mass |
| 106 | a-10 | 5 parts by mass |
| 107 | N-3 | 5 parts by mass |
| 108 | N-4 | 5 parts by mass |

(Image Formation)

The ink sheet of Reference Example and the image-receiving sheets of the above samples 101 to 108 were processed such that each of these sheets could be mounted on a sublimate-type printer (trade name: DPB 1500, manufactured by Nidec Copal Corporation.); and, a black solid image was outputted by setting the printer such that a maximum density would be obtained in a high speed printing mode.

(Dmax Evaluation)

The Visual Density of the Black Solid Image Obtained in the Above Condition was Measured by a Photographic Densitometer (manufactured by X-Rite Incorporated). The obtained results are shown in Table 2.

(Evaluation of Image Defects)

The number of white void image defects that can be visually detected on the black solid image obtained in the above condition was measured. The number of white void image defects 0.5 mm or more in diameter was counted, and image defect was evaluated based on the count per one image sheet 12 cm×10 cm in size. The obtained results are shown in Table 2.

TABLE 2

| | Dmax density | Image defects |
|---|---|---|
| Sample 101 (Comparative example) | 1.65 | 30 |
| Sample 102 (Comparative example) | 2.13 | 77 |
| Sample 103 (This invention) | 2.15 | 9 |
| Sample 104 (This invention) | 2.16 | 10 |
| Sample 105 (This invention) | 2.15 | 5 |
| Sample 106 (This invention) | 2.18 | 7 |
| Sample 107 (This invention) | 2.10 | 9 |
| Sample 108 (This invention) | 2.07 | 10 |

From a comparison between Sample 101 and Sample 102, it is understood that, although the maximum density Dmax was increased by providing the hollow-polymer-containing intermediate layer, the surface condition was degraded. On the other hand, Samples 103 to 108 according to the present invention, wherein their respective surfactants were added to the same hollow-polymer-containing intermediate layer B as provided in Sample 102, were significantly reduced in number of occurrences of image defects, and obtained beautiful images.

Example 2

Samples were prepared in the same manners as in Example 1, except that the hollow latex polymer was changed from MH5055 (trade name, manufactured by Zeon Corporation) to SX866B (trade name, manufactured by JSR Corporation). It is noted that SX866B was used so that the solid content in the hollow latex polymer, expressed in parts by mass, would be the same to that of MH5055. Evaluations made in the same manner as in Example 1 showed that satisfactory results were obtained in Example 2 also.

INDUSTRIAL APPLICABILITY

The heat-sensitive transfer image-receiving sheet of the present invention is useful since it has high sensitivity, is free from image defects, and can be formed at low costs.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A heat-sensitive transfer image-receiving sheet, having, on a support, at least one layer containing an organic hollow polymeric particle, wherein the layer containing the organic hollow polymeric particle comprises an anionic surfactant represented by the following formula (III):

Formula [III]

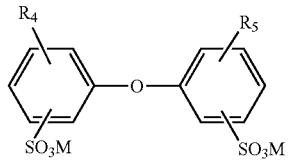

wherein, in formula [III], $R_4$ represents an alkyl group having 6 to 18 carbon atoms, $R_5$ represent a hydrogen atom or an alkyl group having 6 to 18 carbon atoms, and M represents a hydrogen atom or a cation.

2. The heat-sensitive transfer image-receiving sheet as claimed in claim 1, wherein the layer containing the organic hollow polymeric particle and the anionic surfactant is a heat insulation layer.

3. The heat-sensitive transfer image-receiving sheet as claimed in claim 1, wherein the anionic surfactant is added in an amount of 0.1 to 50 mass %, based on the organic hollow polymeric particle.

4. The heat-sensitive transfer image-receiving sheet as claimed in claim 1, wherein the amount of the organic hollow polymeric particle is 1 to 100 $g/m^2$ in the layer containing the organic hollow polymeric particle and the anionic surfactant.

5. The heat-sensitive transfer image-receiving sheet as claimed in claim 1, wherein the particle size of the organic hollow polymeric particle is 0.1 to 20 μm.

6. The heat-sensitive transfer image-receiving sheet as claimed in claim 1, wherein the heat-insulation layer is formed using an aqueous-type coating solution.

* * * * *